US008171652B2

(12) United States Patent
Py

(10) Patent No.: US 8,171,652 B2
(45) Date of Patent: May 8, 2012

(54) PENETRABLE AND RESEALABLE LYOPHILIZATION METHOD

(75) Inventor: Daniel Py, Larchmont, NY (US)

(73) Assignee: Medical Instill Technologies, Inc., New Milford, CT (US)

( * ) Notice: Subject to any disclaimer, the term of this patent is extended or adjusted under 35 U.S.C. 154(b) by 0 days.

(21) Appl. No.: 13/169,586

(22) Filed: Jun. 27, 2011

(65) Prior Publication Data

US 2011/0253250 A1 Oct. 20, 2011

Related U.S. Application Data

(62) Division of application No. 11/789,507, filed on Apr. 24, 2007, now Pat. No. 7,966,746.

(60) Provisional application No. 60/794,642, filed on Apr. 24, 2006.

(51) Int. Cl.
*F26B 5/04* (2006.01)

(52) U.S. Cl. ..... 34/287; 34/559; 34/417; 34/242; 141/7; 141/301; 604/30

(58) Field of Classification Search ..... 34/287, 34/559, 4, 13, 417, 524, 92, 90, 24, 2; 141/7, 141/301; 604/30
See application file for complete search history.

(56) References Cited

U.S. PATENT DOCUMENTS 2,186,908 A 1/1940 Page et al.
2,842,276 A 7/1958 Butler
3,261,694 A 7/1966 Forkner
3,293,773 A 12/1966 Frazer et al.
3,454,178 A 7/1969 Bender et al.
4,185,628 A 1/1980 Kopfer
4,261,474 A 4/1981 Cohen
4,471,879 A 9/1984 Connor et al.
4,510,169 A 4/1985 Linner
4,567,847 A 2/1986 Linner
4,609,102 A 9/1986 Blum
4,676,070 A 6/1987 Linner
4,742,690 A 5/1988 Linner
(Continued)

FOREIGN PATENT DOCUMENTS

EP 960623 A2 * 12/1999
(Continued)

OTHER PUBLICATIONS

International Search Report and Written Opinion mailed Nov. 26, 2007 by ISA/US in PCT/US07/10100.

*Primary Examiner* — Stephen M. Gravini
(74) *Attorney, Agent, or Firm* — McCarter & English, LLP

(57) ABSTRACT

Device and method for lyophilizing a substance within the device and storing therein the lyophilized substance. The device defines a chamber for receiving therein the substance to be lyophilized, a penetrable and resealable portion of the device is penetrable or pierceable by a needle for filling the device with the substance, and a resulting hole therein is resealable by transmitting radiation from a radiation source thereon. A filter is connectable in fluid communication between an interior and exterior of the chamber for permitting fluid to flow therethrough in a direction from the interior to the exterior of the chamber, and for substantially preventing contaminants from flowing therethrough in a direction from the exterior to the interior of the chamber.

29 Claims, 4 Drawing Sheets

U.S. PATENT DOCUMENTS

| | | | | |
|---|---|---|---|---|
| 4,745,771 | A | | 5/1988 | Linner et al. |
| 4,799,361 | A | | 1/1989 | Linner |
| 4,815,619 | A | | 3/1989 | Turner et al. |
| 4,834,149 | A | | 5/1989 | Fournier et al. |
| 4,865,871 | A | | 9/1989 | Livesey et al. |
| 4,883,507 | A | | 11/1989 | Rey et al. |
| 4,981,464 | A | | 1/1991 | Suzuki |
| 5,024,830 | A | | 6/1991 | Linner |
| 5,100,010 | A | | 3/1992 | Waters |
| 5,137,511 | A | | 8/1992 | Reynolds |
| 5,188,628 | A | | 2/1993 | Rani et al. |
| 5,336,616 | A | | 8/1994 | Livesey et al. |
| 5,340,541 | A | | 8/1994 | Jackson et al. |
| 5,364,369 | A | | 11/1994 | Reynolds |
| 5,509,433 | A | | 4/1996 | Paradis |
| 5,522,155 | A | | 6/1996 | Jones |
| 5,549,141 | A | | 8/1996 | Meador et al. |
| 5,596,814 | A | | 1/1997 | Zingle et al. |
| 5,641,004 | A | | 6/1997 | Py |
| 5,650,192 | A | * | 7/1997 | Britton et al. ..... 427/2.19 |
| 5,656,498 | A | | 8/1997 | Iijima et al. |
| 5,700,426 | A | | 12/1997 | Schmitthaeusler et al. |
| 5,702,019 | A | | 12/1997 | Grimard |
| 5,727,333 | A | * | 3/1998 | Folan ..... 34/285 |
| 5,732,837 | A | | 3/1998 | Jones |
| 5,779,668 | A | | 7/1998 | Grabenkort |
| 5,780,295 | A | * | 7/1998 | Livesey et al. ..... 435/307.1 |
| 5,823,373 | A | | 10/1998 | Sudo et al. |
| 5,837,193 | A | * | 11/1998 | Childers et al. ..... 422/28 |
| 5,871,110 | A | | 2/1999 | Grimard et al. |
| 5,871,908 | A | | 2/1999 | Henco et al. |
| 5,876,372 | A | | 3/1999 | Grabenkort et al. |
| 5,937,536 | A | | 8/1999 | Kieselbach et al. |
| 5,971,181 | A | | 10/1999 | Niedospial et al. |
| 6,003,702 | A | | 12/1999 | Grimard et al. |
| 6,021,824 | A | | 2/2000 | Larsen et al. |
| D425,205 | S | | 5/2000 | Henigan et al. |
| 6,058,625 | A | | 5/2000 | Kieselbach et al. |
| 6,070,623 | A | | 6/2000 | Aneas |
| D430,939 | S | | 9/2000 | Zukor et al. |
| 6,148,536 | A | | 11/2000 | Iijima |
| 6,158,146 | A | | 12/2000 | Kieselbach et al. |
| 6,168,037 | B1 | | 1/2001 | Grimard |
| 6,170,800 | B1 | | 1/2001 | Meloul |
| 6,267,154 | B1 | | 7/2001 | Felicelli et al. |
| 6,290,680 | B1 | | 9/2001 | Forsberg et al. |
| 6,306,423 | B1 | | 10/2001 | Donovan et al. |
| 6,312,708 | B1 | | 11/2001 | Donovan |
| 6,383,509 | B1 | | 5/2002 | Donovan et al. |
| 6,509,006 | B1 | | 1/2003 | Platz et al. |
| 6,551,267 | B1 | | 4/2003 | Cohen et al. |
| 6,564,471 | B1 | | 5/2003 | Sutherland et al. |
| 6,582,728 | B1 | | 6/2003 | Platz et al. |
| 6,604,561 | B2 | | 8/2003 | Py |
| 6,610,250 | B1 | | 8/2003 | Tuma |
| 6,649,267 | B2 | | 11/2003 | Agawa et al. |
| 6,684,916 | B2 | | 2/2004 | Py |
| 6,696,002 | B1 | | 2/2004 | Hekal |
| 6,797,258 | B2 | | 9/2004 | Platz et al. |
| 6,921,527 | B2 | | 7/2005 | Platz et al. |
| 6,929,040 | B2 | | 8/2005 | Py |
| 6,931,888 | B2 | | 8/2005 | Shekunov et al. |
| 6,962,006 | B2 | | 11/2005 | Chickering et al. |
| 6,984,395 | B2 | | 1/2006 | Boch et al. |
| 7,048,932 | B2 | | 5/2006 | Chow et al. |
| 7,073,349 | B2 | | 7/2006 | Shekunov et al. |
| 7,077,176 | B2 | | 7/2006 | Py |
| 7,097,827 | B2 | | 8/2006 | Platz et al. |
| 7,100,646 | B2 | | 9/2006 | Py |
| 7,112,341 | B1 | | 9/2006 | Nagarajan et al. |
| 7,141,547 | B2 | | 11/2006 | Rosen et al. |
| 7,186,241 | B2 | | 3/2007 | Py |
| 7,189,690 | B2 | | 3/2007 | Rosen et al. |
| 7,223,558 | B2 | | 5/2007 | Wu et al. |
| 7,238,660 | B2 | | 7/2007 | Rosen et al. |
| 7,238,667 | B2 | | 7/2007 | Rosen et al. |
| 7,456,256 | B2 | | 11/2008 | Wu et al. |
| 7,521,424 | B2 | | 4/2009 | Rosen et al. |
| 7,568,509 | B2 | | 8/2009 | Py |
| 7,569,384 | B2 | | 8/2009 | Rosen et al. |
| 7,592,010 | B2 | | 9/2009 | Rosen et al. |
| 7,662,864 | B2 | | 2/2010 | Kanamathareddy et al. |
| 7,705,134 | B2 | | 4/2010 | Wu et al. |
| 7,765,713 | B2 | * | 8/2010 | Ehrhard et al. ..... 34/89 |
| 7,799,759 | B2 | | 9/2010 | Rosen et al. |
| 7,847,079 | B2 | | 12/2010 | Rosen et al. |
| 7,966,746 | B2 | * | 6/2011 | Py ..... 34/413 |
| 2002/0056206 | A1 | | 5/2002 | Pace et al. |
| 2002/0161334 | A1 | | 10/2002 | Castellano et al. |
| 2003/0035843 | A1 | | 2/2003 | Livesey et al. |
| 2003/0088216 | A1 | | 5/2003 | Py |
| 2003/0143191 | A1 | | 7/2003 | Bell et al. |
| 2003/0157241 | A1 | | 8/2003 | Hossainy et al. |
| 2003/0195163 | A1 | | 10/2003 | Wu et al. |
| 2003/0222364 | A1 | | 12/2003 | Jackson et al. |
| 2003/0224014 | A1 | | 12/2003 | Chow et al. |
| 2003/0232359 | A1 | | 12/2003 | Ramanathan et al. |
| 2004/0002449 | A1 | | 1/2004 | Iruela-Arispe et al. |
| 2004/0009915 | A1 | | 1/2004 | Chang et al. |
| 2004/0030098 | A1 | | 2/2004 | Lee et al. |
| 2004/0118007 | A1 | | 6/2004 | Chickering et al. |
| 2004/0134091 | A1 | | 7/2004 | Chickering et al. |
| 2004/0137004 | A1 | | 7/2004 | Glenn et al. |
| 2004/0139624 | A1 | | 7/2004 | Chickering et al. |
| 2004/0154317 | A1 | | 8/2004 | Shekunov et al. |
| 2004/0208869 | A1 | | 10/2004 | Allan |
| 2004/0208870 | A1 | | 10/2004 | Allan |
| 2004/0256026 | A1 | | 12/2004 | Py |
| 2005/0048121 | A1 | | 3/2005 | East et al. |
| 2005/0048620 | A1 | | 3/2005 | Wu et al. |
| 2005/0054570 | A1 | | 3/2005 | Rosen et al. |
| 2005/0080136 | A1 | | 4/2005 | Watanabe et al. |
| 2005/0086830 | A1 | * | 4/2005 | Zukor et al. ..... 34/443 |
| 2005/0175665 | A1 | | 8/2005 | Hunter et al. |
| 2005/0175703 | A1 | | 8/2005 | Hunter et al. |
| 2005/0178395 | A1 | | 8/2005 | Hunter et al. |
| 2005/0178396 | A1 | | 8/2005 | Hunter et al. |
| 2005/0178462 | A1 | | 8/2005 | Py |
| 2005/0182463 | A1 | | 8/2005 | Hunter et al. |
| 2005/0183731 | A1 | | 8/2005 | Hunter et al. |
| 2005/0186244 | A1 | | 8/2005 | Hunter et al. |
| 2005/0186664 | A1 | | 8/2005 | Rosen et al. |
| 2005/0187140 | A1 | | 8/2005 | Hunter et al. |
| 2005/0196421 | A1 | | 9/2005 | Hunter et al. |
| 2005/0208095 | A1 | | 9/2005 | Hunter et al. |
| 2006/0003367 | A1 | | 1/2006 | Wu et al. |
| 2006/0014254 | A1 | | 1/2006 | Haseltine et al. |
| 2006/0073162 | A1 | | 4/2006 | Chow et al. |
| 2006/0166364 | A1 | | 7/2006 | Senesac |
| 2006/0194735 | A1 | | 8/2006 | Rosen et al. |
| 2006/0210960 | A1 | | 9/2006 | Livesey et al. |
| 2006/0276396 | A1 | | 12/2006 | Rosen et al. |
| 2006/0286635 | A1 | | 12/2006 | Rosen et al. |
| 2007/0027306 | A1 | | 2/2007 | Rosen et al. |
| 2007/0048282 | A1 | | 3/2007 | Rosen et al. |
| 2007/0084524 | A1 | | 4/2007 | Py |
| 2007/0156102 | A1 | | 7/2007 | Py |
| 2007/0167853 | A1 | | 7/2007 | Melker et al. |
| 2007/0178088 | A1 | | 8/2007 | Wu et al. |
| 2007/0203448 | A1 | | 8/2007 | Melker et al. |
| 2007/0208134 | A1 | | 9/2007 | Hunter et al. |
| 2007/0224128 | A1 | | 9/2007 | Dennis et al. |
| 2007/0244047 | A1 | | 10/2007 | Rosen et al. |
| 2007/0259815 | A1 | | 11/2007 | Rosen et al. |
| 2007/0292941 | A1 | | 12/2007 | Handique et al. |
| 2007/0299043 | A1 | | 12/2007 | Hunter et al. |
| 2008/0004206 | A1 | | 1/2008 | Rosen et al. |
| 2008/0028632 | A1 | | 2/2008 | Py |
| 2008/0039773 | A1 | | 2/2008 | Py |
| 2008/0057004 | A1 | | 3/2008 | Bell et al. |
| 2008/0071063 | A1 | | 3/2008 | Allan et al. |
| 2008/0095806 | A1 | | 4/2008 | Bathurst et al. |
| 2008/0112972 | A1 | | 5/2008 | Truong-Le |
| 2008/0146503 | A1 | | 6/2008 | Rosen et al. |
| 2008/0153751 | A1 | | 6/2008 | Rosen et al. |
| 2008/0161243 | A1 | | 7/2008 | Rosen et al. |
| 2008/0167238 | A1 | | 7/2008 | Rosen et al. |

2008/0167239 A1 7/2008 Rosen et al.
2008/0167240 A1 7/2008 Rosen et al.
2008/0194481 A1 8/2008 Rosen et al.
2008/0213886 A1 9/2008 Rosen et al.
2008/0229609 A1 9/2008 Bronshtein
2008/0234652 A1 9/2008 McCarthy et al.
2008/0234653 A1 9/2008 McCarthy et al.
2008/0234654 A1 9/2008 McCarthy et al.
2008/0276482 A1 11/2008 Broughall et al.
2008/0293629 A1 11/2008 Rosen et al.
2009/0029914 A1 1/2009 Rosen et al.
2009/0047358 A1 2/2009 Weers et al.
2009/0053238 A1 2/2009 Allan
2009/0088385 A1 4/2009 Wu et al.
2009/0093402 A1 4/2009 Rosen et al.
2009/0099073 A1 4/2009 Rosen et al.
2009/0107001 A1 4/2009 McCarthy
2009/0113753 A1 5/2009 Pepper et al.
2009/0158612 A1* 6/2009 Thilly et al. ..... 34/285
2009/0258850 A1 10/2009 Frincke et al.
2010/0048472 A1 2/2010 Rosen et al.
2010/0093627 A1 4/2010 Rosen et al.
2010/0129316 A1 5/2010 Levitt
2010/0152410 A1 6/2010 East et al.
2010/0154245 A1* 6/2010 Py ..... 34/287
2010/0254944 A1 10/2010 Subramanian et al.
2010/0254985 A1 10/2010 Allan et al.
2010/0286791 A1 11/2010 Goldsmith
2010/0291033 A1 11/2010 Rosen et al.
2010/0297231 A1* 11/2010 Vehring et al. ..... 424/484
2010/0317518 A1 12/2010 Stevens et al.
2011/0002888 A1 1/2011 Rosen et al.
2011/0009312 A1 1/2011 Rosen et al.
2011/0020947 A1 1/2011 Bedingham et al.
2011/0253250 A1* 10/2011 Py ..... 141/1

FOREIGN PATENT DOCUMENTS

GB 2026995 A 2/1980
JP 06211645 A 8/1994
JP 07165252 A 6/1995
JP 10165480 A 6/1998
JP 10234822 A 9/1998
JP 2002220344 A 8/2002
WO WO 96/06018 2/1996
WO WO 9720181 A1 6/1997
WO WO 9918402 A1 4/1999
WO WO 2007038773 A1 * 4/2007
WO WO 2007127286 A2 * 11/2007

* cited by examiner

PENETRABLE AND RESEALABLE LYOPHILIZATION METHOD

CROSS-REFERENCE TO RELATED APPLICATIONS

This application is a divisional application of U.S. application Ser. No. 11/789,507, filed Apr. 24, 2007, now U.S. Pat. No. 7,966,746 issued Jun. 28, 2011, claiming priority to U.S. Provisional Application No. 60/794,642, filed Apr. 24, 2006, the contents of all of which are hereby incorporated by reference in their entirely as part of the present disclosure as if fully set forth herein.

FIELD OF THE INVENTION

The present invention generally relates to the sealing and dispensing of substances, and more particularly, to the needle filling, sealing, lyophilizing, reconstituting and dispensing of substances.

BACKGROUND INFORMATION

In current technology, lyophilization has resolved several problems in the food and pharmaceutical industries. For instance, lyophilized substances are currently being effectively utilized as the basis for injectable compounds, such as human growth hormones (HGHs), biologicals, vaccines, immunomodulators, medicaments, and the like. Lyophilization involves the rapid freezing of a substance at a very low temperature followed by rapid dehydration by sublimation in a high vacuum. Lyophilization processes can reduce or eliminate the need for difficult storage and handling arrangements and may provide a pathway to a product with a favorable shelf life. In addition to its role in making certain injectable medicaments feasible, lyophilization is being used to find alternatives to a variety of dry-powder-filled products that have undesirable processing and/or product characteristics. Although these powder-filled products are less expensive to produce, their manufacture can involve challenges in processing safety (powder control), uniformity (blending), aesthetics, inspectability, reconstitutability, stability (residual moisture and solvent control), and particulate control. Regulatory and industry professionals recognize that these characteristics are better controlled or overcome with the development of lyophilized forms of such products.

A prior art lyophilization process utilizes a lyophilization chamber having shelves suitable for accommodating at least one chemically inert container (e.g., a glass vial), and, in essence, consists of a filling stage, a freezing stage, a primary drying stage, and a secondary drying stage. During the filling stage a predetermined amount of fluid substance or formulation is provided to the container. During the freezing stage the formulation is cooled. Pure crystalline ice forms from the fluid substance, thereby resulting in a freeze concentration of the fluid remainder to a more viscous state that inhibits further crystallization. Ultimately, this highly concentrated and viscous solution solidifies, yielding an amorphous, crystalline, or combined amorphous-crystalline phase. During the primary drying stage, the ice formed during the previous freezing stage is removed by sublimation at sub-ambient temperatures under vacuum. This stage is traditionally carried out at chamber pressures of 40-400 Torr and shelf temperatures ranging from about −30° C. to about +10° C. Throughout this stage, the substance is maintained in the solid state below the collapse temperature of the substance in order to dry the substance with retention of the structure established during the freezing stage. The collapse temperature may be, for example, the glass transition temperature (Tg) in the case of amorphous substances or the eutectic temperature (Te) for crystalline substances. During the secondary drying stage, the relatively small amount of bound water remaining in the matrix is removed by desorption. During this stage, the temperature of the shelf and substance are increased to promote adequate desorption rates and achieve the desired residual moisture.

Typical lyophilization processes require sophisticated mechanical equipment with advanced data acquisition and control systems. For instance, to fill conventional lyophilization containers with sterile substances or compounds to be lyophilized, it is typically necessary to sterilize the unassembled components of the lyophilization container, such as by autoclaving the components and/or exposing the components to gamma radiation. The sterilized components then must be filled and assembled in an aseptic isolator of a sterile filling machine. In some cases, the sterilized components are contained within multiple sealed bags or other sterile enclosures for transportation to the sterile filling machine. In other cases, the sterilization equipment is located at the entry to the sterile filling machine.

One drawback associated with prior art lyophilization cap/container assemblies, and processes and equipment for lyophilization, is that the filling process in combination with the lyophilization process is time consuming, and such processes and equipment can be costly. Further, the relatively complex nature of the filling/lyophilization processes and equipment can lead to more defectively filled containers than otherwise desired. For example, typically there are at least as many sources of failure as there are components. In many cases, there are complex assembly machines for assembling the lyophilization containers that are located within the aseptic area of the filling machine that must be maintained sterile. This type of machinery can be a significant source of unwanted particles or contaminants. Further, isolators are required to maintain sterile air within the barrier enclosure. In closed barrier systems, convection flow is inevitable and thus laminar flow, or substantially laminar flow, cannot be achieved. When operation of an isolator is stopped, a media fill test may have to be performed which can last for several, if not many days, and can lead to repeated interruptions and significant reductions in production output for the pharmaceutical or other product manufacturer that is using the equipment. In order to address such production issues, government-imposed regulations are becoming increasingly sophisticated and are further increasing the cost of already-expensive isolators and like filling equipment. On the other hand, governmental price controls for injectables discourage such major financial investments. Accordingly, there is a concern that fewer companies will be able to afford such increasing levels of investment in sterile filling machines, thus further reducing competition in the marketplace.

Another drawback associated with known lyophilization containers, and processes and equipment for lyophilization, is that during the lyophilization process it is necessary to allow communication between the contents of the container and the ambient atmosphere, which, in effect, increases the vulnerability of the container contents to compromise. Notwithstanding this increased vulnerability, the atmospheric communication is essential in order that moisture may be appropriately vented as needed during the lyophilization process. Conventionally, this venting requirement has been addressed by utilizing a stopper that has an extended lower portion with one or more vent openings therein, and by seating such stopper only partially in the container after the filling stage so that the vent openings of the lower portion expose the contents of the container to the ambient atmosphere. Moisture removed from the contents of the container during lyophilization may thus escape through the vent openings. As a general method of closing the container, shelves in a lyophilization chamber vertically move together to press the stopper down into the container until the vent openings in the lower portion thereof are well inside the container, thereby preventing any further ingress and/or egress of moisture and/or air. A metal seal or crimp also may be used to securely hold the rubber stopper to the container and prevent any unwanted disengagement therewith. Accordingly, conventional lyophilization container/stopper assemblies and related venting techniques, although suitable to provide the required venting, fail to address the desirability of ensuring the integrity of the contents of the lyophilization container.

A further drawback associated with the foregoing lyophilization processes and containers is that the container stoppers may stick to the shelves of the lyophilization chamber. This typically happens at the end of the lyophilization process, which may take as long as 72 hours, after the shelves have moved down to seat the stoppers in the containers. When the shelves are subsequently retracted, some stoppers may stick to the shelves, resulting in at least a small portion of the batch being lost. In extreme cases, the entire batch may be ruined, which can be costly and inefficient.

Still another drawback associated with known lyophilization containers and processes is found in the reconstitution process. As is apparent from the foregoing discussion, it is necessary to reconstitute a lyophilized substance or compound, via a suitable diluent, prior to the administration thereof. Reconstitution is typically accomplished by injecting a diluent (e.g., via a needle syringe) into a container containing the lyophilized substance. During reconstitution, the diluent often interacts with the lyophilized substance so as to cause the lyophilized substance to foam. This foaming effect can create an undesirable head space in the container such that the appropriate amount of diluent is not mixed with the substance, resulting in an improper diluent to compound ratio. This negative foaming effect necessitates waiting some length of time for the foam to subside before proceeding with the administration of the reconstituted substance. Accordingly, it would be advantageous to provide a lyophilization container that minimizes or otherwise reduces this negative foaming effect in comparison to prior art lyophilization containers.

It can be desirable for lyophilized substances to possess certain characteristics including, but not limited to, (1) long term stability, (2) short reconstitution time, (3) elegant cake appearance, (4) maintenance of original dosage characteristics upon reconstitution, including solution properties, structure and/or conformation of proteins, as well as particle-size distribution of suspensions, and (5) isotonicity upon reconstitution. Control and monitoring precision, accuracy, and reproducibility as well as product aesthetics, stability, and reconstitution characteristics are factors to be addressed in the evolution of lyophilization. Further, many substances to be lyophilized, such as antibiotics and medicaments, immunological products, substances derived from genetic engineering, high molecular weight proteins, and sophisticated peptides are very fragile, difficult to freeze, and highly sensitive to residual moisture content. Accordingly, the demand for improved lyophilization containers, processes, equipment and/or techniques for producing, in a reproducible and reliable manner, quantities, large and small, of lyophilized substances will necessarily increase.

Accordingly, it is an object of the present invention to overcome one or more of the above-described drawbacks and disadvantages of the prior art and to address the need for improved lyophilization devices, processes, equipment and/or techniques.

SUMMARY OF THE INVENTION

In accordance with a first aspect, a device is for use in lyophilizing a substance and storing therein the lyophilized substance. The device is penetrable by a needle for filling the device with the substance to be lyophilized, and a resulting needle hole in the device is resealable by transmitting thereon energy or radiation from a source. The device comprises a body defining a chamber for receiving therein the substance to be lyophilized. A needle penetrable and resealable portion of the device is pierceable with a needle to form a needle aperture therethrough to fill the chamber with the substance to be lyophilized through the needle, and is resealable to hermetically seal the needle aperture by applying radiation thereto. In some embodiments, a filter is connectable in fluid communication between an interior and exterior of the chamber for permitting fluid to flow therethrough in a direction from the interior to the exterior of the chamber, and for substantially preventing contaminants from flowing therethrough in a direction from the exterior to the interior of the chamber.

In some embodiments, the device further comprises a securing member coupled to the body for securing a needle penetrable and laser resealable portion thereto. In some such embodiments, the needle penetrable and laser resealable portion defines at least one first vent aperture, the securing member defines at least one second vent aperture in fluid communication with the at least one first vent aperture, and the filter is located therebetween. In some such embodiments, the needle penetrable and laser resealable portion defines a plurality of first vent apertures angularly spaced relative to each other, the securing member defines a plurality of second vent apertures angularly spaced relative to each other, and at least a plurality of the second vent apertures are in fluid communication with respective first vent apertures. In some such embodiments, the first vent apertures define a first cross-sectional flow area for permitting fluid to flow therethrough, the second vent apertures define a second cross-sectional flow area for permitting fluid to flow therethrough, and the second cross-sectional flow area is greater than the first cross-sectional flow area. In some such embodiments, the first vent apertures define a first annular array of vent apertures, and the second vent apertures defining a second annular array of vent apertures. In some embodiments, the first annular array defines a first inner diameter and a first outer diameter, the second annular array defines a second inner diameter and a second outer diameter, the second outer diameter is approximately equal to or greater than the first outer diameter, and the second inner diameter is approximately equal to or less than the first inner diameter. I further embodiments, at least a plurality of first vent apertures are in fluid communication with respective second vent apertures at substantially any angular position of the needle penetrable and laser resealable portion relative to the securing member, or at substantially any angular position of the securing member relative to the needle penetrable and laser resealable portion.

The device may take any of numerous different forms for lyophilizing and storing therein any of numerous different lyophilized substances. In some embodiments, the body forms either a vial, a container, or a syringe, and the needle penetrable and resealable portion is defined by a stopper.

In some embodiments, the filter is located between a needle penetrable and laser resealable portion and the securing member. In some such embodiments, the filter is either (i) fixedly secured to the needle penetrable and laser resealable portion, (ii) mechanically connected between the needle penetrable and laser resealable portion and the securing member, and/or (iii) insert molded with the needle penetrable and laser resealable portion. In some embodiments, the filter is formed of a porous material having a pore size distribution within the range of about 0.05 microns to about 5 microns. In some such embodiments, the filter material is hydrophobic.

The device in some embodiments further comprises a cover connected to the securing member, the body, and/or a needle penetrable and laser resealable portion, that covers an exposed portion of the needle penetrable and laser resealable portion. In some embodiments, the cover forms a substantially fluid-tight seal between the needle penetrable and laser resealable portion and the ambient atmosphere, and forms a barrier to the transmission of moisture and vapor therethrough. In some embodiments, the cover includes a frangible portion that is movable between a closed position connected to the cover and substantially sealing the needle penetrable and laser resealable portion from the ambient atmosphere, and an open position removed from the cover and exposing at least a portion of the needle penetrable and laser resealable portion. Some embodiments further comprise a sealing member overlying the filter and sealing the filter from the ambient atmosphere. In some such embodiments, the sealing member forms a part of, or is fixedly secured to an underside of the cover.

In other embodiments, a needle penetrable and laser resealable portion defines a predetermined wall thickness in an axial direction thereof, is laser resealable to hermetically seal the needle aperture by applying laser radiation at a predetermined wavelength and power thereto, and includes a thermoplastic that substantially prevents the formation of particles released into the chamber from the needle penetrable and laser resealable portion during penetration by and withdrawal of the needle. The thermoplastic includes a predetermined amount of pigment that allows the thermoplastic to substantially absorb laser radiation at the predetermined wavelength, substantially prevent the passage of radiation through the predetermined wall thickness thereof, and hermetically seal a needle aperture formed in the needle penetration region thereof in a predetermined time period. In some embodiments, the thermoplastic includes an olefin within the range of about 3% to about 20% by weight, a styrene block copolymer within the range of about 80% to about 97% by weight, and a lubricant. Also in some embodiments, the thermoplastic includes (i) a first polymeric material in an amount within the range of about 80% to about 97% by weight and defining a first elongation, (ii) a second polymeric material in an amount within the range of about 3% to about 20% by weight and defining a second elongation that is less than the first elongation of the first material, and (iii) a lubricant in an amount that reduces friction forces at an interface of the needle and body. In some such embodiments, the first material is a styrene block copolymer and the second material is an olefin. In some embodiments, the predetermined amount of pigment is within the range of about 0.3% to about 0.6% by weight.

In accordance with another aspect, a device is for use in lyophilizing a substance and storing therein the lyophilized substance. The device is penetrable by a needle for filling the device with the substance to be lyophilized, and a resulting needle hole in the device is laser resealable by transmitting thereon laser radiation from a laser source. The device comprises first means for forming an aseptic chamber for receiving therein the substance to be lyophilized, and second means for piercing with a needle to form a needle aperture therethrough and fill the chamber with the substance to be lyophilized through the needle, and for laser resealing to hermetically seal the needle aperture by applying laser radiation thereto. In some embodiments, the device further includes third means connectable in fluid communication between an interior and exterior of the chamber for permitting fluid to flow therethrough from the interior to the exterior of the chamber, and for filtering out and substantially preventing any contaminants from flowing therethrough from the exterior to the interior of the chamber.

In some embodiments, the first means is a body of the device defining therein the chamber; the second means is a needle penetrable and laser resealable portion that is pierceable with a needle to form a needle aperture therethrough to fill the chamber with the substance to be lyophilized through the needle, and is laser resealable to hermetically seal the needle aperture by applying laser radiation thereto; and the third means is a filter connectable in fluid communication between an interior and exterior of the chamber that permits fluid to flow therethrough in a direction from the interior to the exterior of the chamber, and substantially prevents contaminants from flowing therethrough in a direction from the exterior to the interior of the chamber.

Another aspect is a method of filling a device with a substance to be lyophilized, lyophilizing the substance within the device, and storing the lyophilized substance within the device. The method may comprise the following steps: (i) providing a device including a body defining a chamber, and a needle penetrable and resealable portion in fluid communication with the chamber; (ii) penetrating the needle penetrable and resealable portion with a tip of the needle such that a flow aperture of the needle is in fluid communication with the chamber of the device; (iii) introducing the substance to be lyophilized through the needle and into the chamber of the device; (iv) withdrawing the needle from the needle penetrable and resealable portion; (v) lyophilizing the substance within the chamber, causing fluid to flow out of the chamber during lyophilization, and preventing contaminants from flowing into the chamber during lyophilization; and (vi) transmitting radiation from the radiation source onto the needle penetrated region of the needle penetrable and resealable portion, and hermetically sealing the needle aperture formed in the needle penetrable and resealable portion.

In some embodiments, the providing step further includes providing a device including a filter in fluid communication between the interior and exterior of the chamber; and the lyophilization step includes lyophilizing the substance within the chamber, causing fluid to flow through the filter and out of the chamber during lyophilization, and preventing contaminants from flowing through the filter and into the chamber during lyophilization. In some embodiments, the lyophilization occurs prior to the step of transmitting radiation, and in other embodiments, the lyophilization occurs after the step of transmitting radiation. In some embodiments, the lyophilization includes freezing the substance within the chamber; subjecting the device to vacuum and removing ice within the chamber by sublimation through the filter; and then increasing the temperature within the chamber and desorbing residual moisture from the substance within the chamber through the filter.

In some embodiments, the method further comprises the step of sealing the filter and chamber with respect to the ambient atmosphere after the step of lyophilizing the substance within the chamber.

The method also may further comprise the step of sterilizing the chamber. In some embodiments, the sterilizing step is performed prior to introducing the substance to be lyophilized through the needle and into the chamber. In some embodiments, the sterilizing step is selected from the group including (i) applying gamma radiation, (ii) applying e-beam radiation, and (iii) applying laser radiation, to the chamber.

In some embodiments, the method further comprises the step of configuring at least one of a needle penetrable and resealable portion and needle to substantially prevent the formation of particles released into the chamber during needle penetration and withdrawal. In some such embodiments, the configuring step includes providing a thermoplastic needle penetrable and laser resealable portion including a styrene block copolymer and an olefin, and providing a lubricant at an interface of the needle and needle penetrable and laser resealable portion. In some such embodiments, the configuring step includes providing a thermoplastic needle penetrable and laser resealable portion including (i) a first polymeric material in an amount within the range of about 80% to about 97% by weight and defining a first elongation, (ii) a second polymeric material in an amount within the range of about 3% to about 20% by weight and defining a second elongation that is less than the first elongation of the first material, and (iii) a lubricant in an amount that reduces friction forces at an interface of the needle and needle penetrable and laser resealable portion.

One advantage of the present invention is that the device is assembled forming a sealed empty chamber prior to filling, thus enhancing the ability to maintain sterile conditions throughout the filling process. As a result, the present invention can significantly reduce processing time and cost in comparison to prior art stoppers/containers and related filling systems, and moreover, significantly increase the assurance of sterility throughout the assembly and filling processes.

Other advantages of the present invention, and/or the disclosed illustrative embodiments thereof, will become more readily apparent in view of the following detailed description of embodiments and accompanying drawings.

BRIEF DESCRIPTION OF THE DRAWINGS

So that those having ordinary skill in the art to which the present invention appertains will more readily understand how to make and use the same, reference may be had to the drawings wherein:

FIG. 4*a* is a cross-sectional view of a securing ring of the device of FIG. 1 and an optional sealing member seated between the securing ring and cover for sealing the filter and interior chamber with respect to the ambient atmosphere.

DETAILED DESCRIPTION OF EMBODIMENTS OF THE INVENTION

Reference is now made to the accompanying figures for the purpose of describing, in detail, aspects of the present disclosure. The figures and accompanying detailed description are provided as examples of the disclosed subject matter and are not intended to limit the scope thereof.

Figure 1:
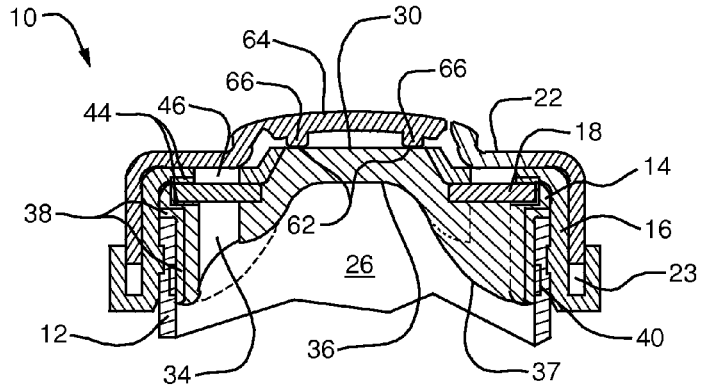
FIG. 1 is a cross-sectional view of a lyophilization device including a needle penetrable and laser resealable stopper for needle filling the device with a substance to be lyophilized, and a filter for allowing fluid to flow out of the device during lyophilization of the filled substance.

Referring to FIG. 1, a lyophilization device is designated generally by reference numeral 10. The device 10 includes a body 12 defining therein a chamber for receiving the substance to be lyophilized, a needle penetrable and laser resealable portion or stopper 14 received within the open end of the body 12, a locking member or securing ring 16 for fixedly securing the stopper to the body, and a sterile filter 18 for allowing fluids to flow out of the chamber during lyophilization of the substance to be filled therein, and for substantially preventing any contaminants from entering the chamber from the exterior of the device. As described further below, the device 10 may further include a vent seal 20 (FIG. 4*a*) overlying the securing ring 16 and sealing the filter 18 from the ambient atmosphere, and a protective cover 22 for sealing the stopper from the ambient atmosphere and/or providing a tamper evident cover.

Figure 2A:
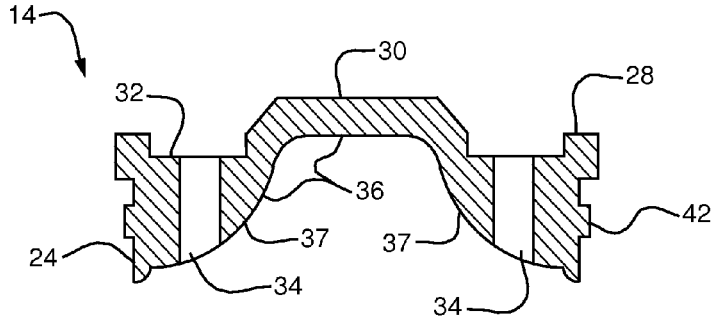
FIG. 2*a* is a cross-sectional view of a needle penetrable and laser resealable stopper of the device of FIG.1.
Figure 2B:
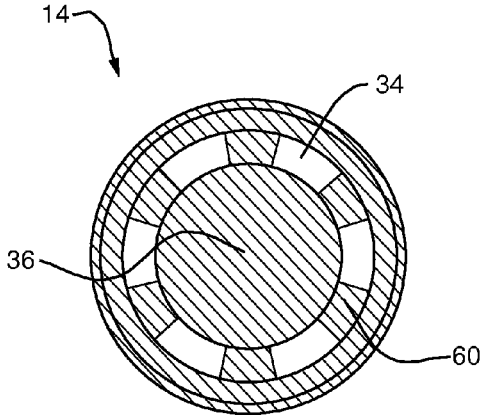
FIG. 2*b* is a bottom plan view of the stopper of FIG. 2*a*.
Figure 2C:
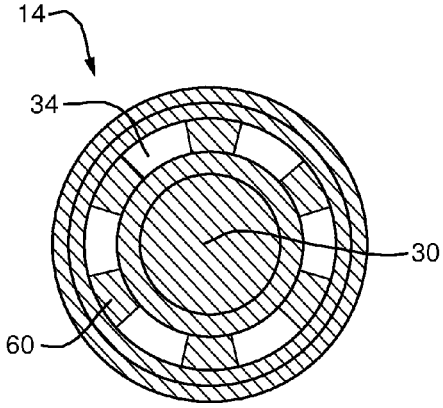
FIG. 2*c* is a top plan view of the stopper of FIG. 2*a*.

Referring to FIGS. 2*a*-2*c*, the stopper 14 has an outer peripheral surface 24 which is adapted and configured for engagement with a body ingress/egress opening 26, an outer upper surface 28 with a needle penetrable and laser resealable portion 30, a filter recess or alcove 32, one or more stopper vents 34 extending through the stopper, and an inner lower surface 36 shaped to facilitate needle filling of the device through the stopper and venting during lyophilization via the stopper vents 34. As can be seen, the lower surface 36 defines an upper region at the base of the needle penetrable and laser resealable portion 30, and an annular region 37 extending downwardly into the opening 26 of the chamber and tapering radially outwardly toward the side wall of the body 12. During needle filling, the needle aperture(s) (not shown) is/are located within the annular region 37 of the lower wall 36 such that the flow of fluid substance from the needle into the chamber is directed laterally onto the annular region and/or onto the side wall of the body. The annular region 37 can define a substantially smooth radius as shown to facilitate in directing the fluid laterally and downwardly into the chamber. Depending on the fluid being dispensed, this configuration can facilitate in reducing turbulence and, in turn, reducing or preventing the formation of foam.

As shown in FIG. 1, the peripheral surface 24 of the stopper 14 provides a first seal 38 between the body and stopper so as to maintain the integrity of a substance retained in the body 12. If desired, the body 12 may define either a protuberance or recess 40 for respectively cooperating with a complementary recess or protuberance 42 defined by the stopper 14 so as to effectuate a seal between the stopper and body. However, as may be recognized by those of ordinary skill in the pertinent art based on the teachings herein, the stopper and body may take any of numerous different configurations that are currently known, or that later become known to effect a fluid-tight seal therebetween. The resealable portion 30, as shown, is at least slightly elevated with respect to the outer upper surface 28 of the stopper 14. This elevated effect advantageously facilitates access to the resealable portion 30 when the stopper is operatively associated with the other components of the device and connected to the body. The filter alcove 32, in contrast to the resealable portion 30, is at least slightly recessed with respect to the outer upper surface 28 to receive therein the filter 18. As can be seen, the stopper 14 cooperates with the securing ring 16 to provide a second seal 44 (best shown in FIG. 1) between the stopper and the securing ring to thereby maintain the integrity of a substance retained in the body 12. The lower surface of the securing ring 16 and/or the outer upper surface 28 of the stopper 14 is configured so that when they are assembled, the filter 18 is effectively pinched about both its inner and outer peripheries between the stopper 14 and securing ring 16 to thereby provide a fluid-tight seal. Additionally, or alternatively, the filter 18 may be sonically welded, insert molded, or otherwise fixedly secured to the stopper 14 and/or the securing ring 16 to accomplish a fluid-tight seal.

The shape, size and configuration of the stopper vents 34 may vary as appropriate for accomplishing different venting effects. As shown in FIG. 4*a*, the securing ring 16 defines a plurality of ring vents 46 angularly spaced relative to each other and that cooperate with the stopper vents 34 during lyophilization to allow requisite venting therethrough. In order to ensure effective venting, it may be necessary for the stopper vents 34 to be in constant fluid communication with ring vents 46 of the securing ring 16 during lyophilization. In addition, as discussed further below, to ensure consistent venting, it is advantageous for the stopper vents 34 and ring vents 46 to cooperate so that irrespective of the positioning or orientation of the securing ring 16 with respect to the stopper 14, or vice-versa, the same overall venting effect and/or effective venting is provided.

As may be recognized by those skilled in the pertinent art based on the teachings herein, the specific geometry and/or configuration of the stopper 14, as well as the features associated with the stopper, can be changed as desired or otherwise required to achieve the desired effects. For example, the particular configuration and/or arrangement of the stopper's lower inner surfaces 36, 37 and/or the stopper vents 34 may be such that when the device is shaken during reconstitution of the lyophilized substance retained in the device, particulate is not trapped and prevented from being dissolved.

Figure 3A:
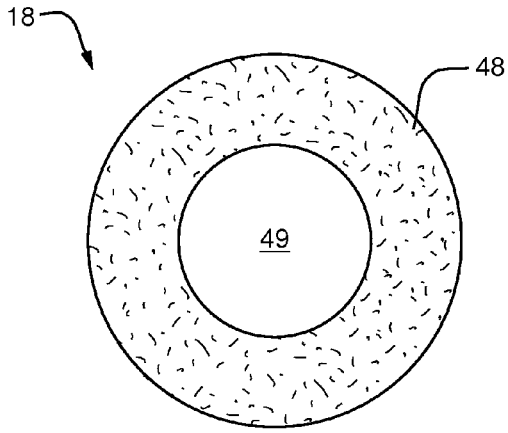
FIG. 3*a* is a plan view of a filter of the device of FIG. 1.
Figure 3B:
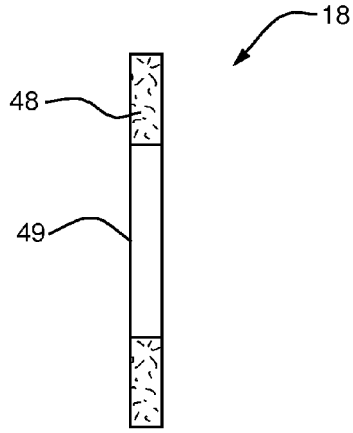
FIG. 3*b* is a cross-sectional view of the filter of FIG. 3*a*.

Referring to FIGS. 3*a* and 3*b*, the illustrated filter 18, as shown, is a single material layer 48. In other aspects, the filter 18 can be a composite of two or more material layers of different material properties. Irrespective of whether the filter is a composite or not, the filter material, in accordance with an aspect, is hydrophobic or liquid impermeable, easily handled during manufacture, and may be cut or shaped to fit any of a variety of geometries. The filter material may be usable over a broad temperature range. In one aspect, the filter material can be formed from a low density extruded, unsintered and highly porous material, such as, a polytetrafluoroethylene (PTFE), an expanded PTFE (ePTFE), or variations thereof as known in the art. The filter material can be designed and/or adjusted to accommodate different application requirements. The filter material, in one aspect, may be porous with, for example, a pore size distribution in the range of about 0.05 microns to about 5 microns. In certain aspects, the filter material can be converted from the hydrophobic form to a hydrophilic form. The PTFE or ePTFE are relatively soft or compressible, and therefore well suited to form fluid-tight seals against the surfaces with which they are compressed, such as the upper surface of the stopper 14 and the lower surface of the securing ring 16 as discussed above and shown in FIG. 1. In addition to the foregoing materials, other filter materials also may be effectively utilized. For example, polyvinylidene fluoride (PVDF, best known as Kynar™), which is an extremely pure opaque white resin that is well suited for non-contaminating applications. PVDF has relatively high mechanical strength and abrasion resistance, and is well suited to resist gamma and UV radiation, which can be advantageous for sterilizing purposes.

In one aspect, the filter material may have an open cell (tortuous path) structure with a void volume in the range of about 30% to about 50%. The filter material may be bonded to nearly any material, including, for example, polypropylene materials, polyethylene materials, polyester materials, Kevlar®, glass fabrics, and a variety of other materials. The porosity of the filter material may be adjusted as desired to accommodate a variety of application requirements. The porosity of the filter material may be uniform in all three axes, which can facilitate constant fluid flow in filtration and/or separation applications. In certain embodiments, the pore size distribution of the filter material is consistent, with nominal values ranging from about 0.05 μm to about 5 μm.

In one embodiment of the device 10, the filter 18 is an approximately 0.2 μm sterilizing filter. In some such embodiments, the filter material is hydrophobic to prevent clogging with water vapor during the freeze drying or lyophilization process. One such filter material is sold by the Millipore Corporation of Bedford, Mass. under the designation Surevent™ PVDF Membrane. Another exemplary filter material is an approximately 0.2 μm sterilizing filter including a PTFE membrane attached to a non-woven polypropylene backing. One such material is sold by Millipore Corporation under the designation Surevent™ PTFE Membrane.

As may be recognized by those skilled in the pertinent art based on the teachings herein, the specific filter material used in the device can be changed as desired to achieve the desired physical or other characteristics. For example, the filter thickness(es) can be modified in order to provide for different venting effects. Alternatively, or in conjunction with such measures, the blend of the filter material may be changed as desired to meet desired sorption levels with the particular product(s) to be contained within the device, and/or to achieve desired MVT characteristics. Still further, the filter can utilize multiple layers of fusible and/or infusible materials, the relative thickness of the different materials can be adjusted to, in turn, modify the venting characteristics of the filter. As also may be recognized by those of ordinary skill in the pertinent art based on the teachings herein, the above-mentioned materials are only exemplary, and may be changed as desired or otherwise required in a particular system.

Figure 4B:
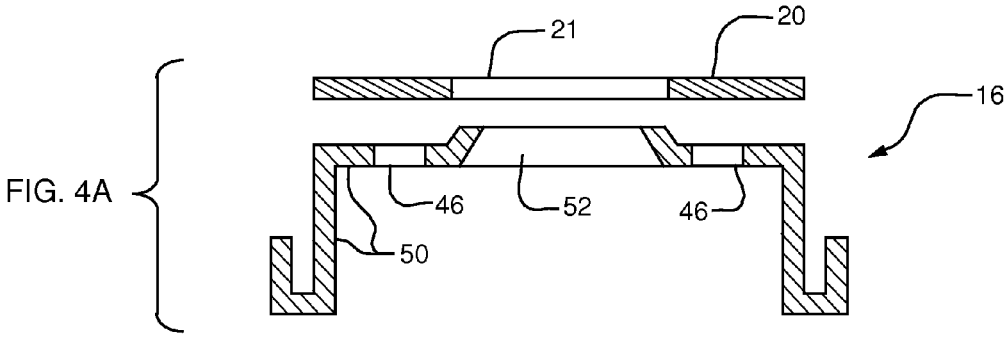
FIG. 4*b* is a bottom plan view of the securing ring of FIG. 4*a*.
Figure 4B:
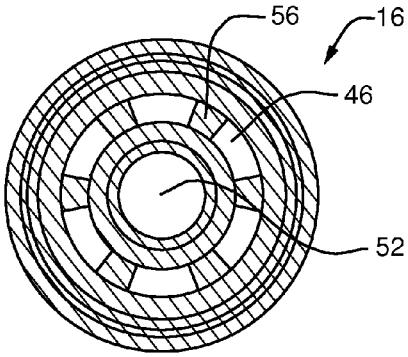
Figure 4C:
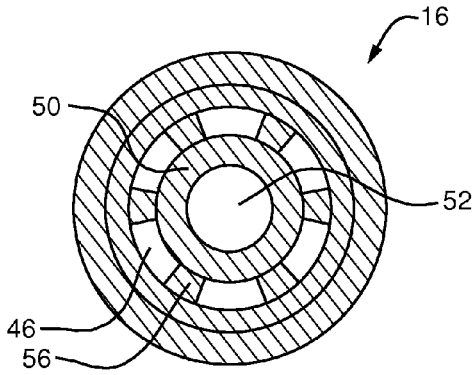
FIG. 4*c* is a top plan view of the securing ring of FIG. 4*a*.

Referring to FIGS. 4*a*-4*c*, the securing ring 16, as shown, is configured to be effectively connected to the body 12 and stopper 14 such that the integrity of the fluid-impermeable seal between the body and stopper (i.e., the first seal 38 in FIG. 1) is effectively maintained. The securing ring 16 may be made from any of a variety of materials, such as any of numerous different thermoplastic materials that are currently known or that later become known. The securing ring 16, in other aspects, also can be formed from a resilient polymeric material and a low-density polyethylene, similar to that used in the resealable portion 30. As it is often difficult to maintain the sterility of the components of the device during the transportation, storage and construction processes, the use of a non-metallic material for the securing ring 16 allows the device to be assembled and subsequently sterilized as a unit prior to filling the body with a substance to be lyophilized, for example, via a gamma sterilization technique, an e-beam sterilization technique, or other irradiation or sterilization process.

The securing ring 16 has an inner portion 50 for operatively connecting to or engaging with the body 12 and stopper 14. The inner portion 50 is configured to effectuate the second seal 44 (FIG. 1) for sealing the interface between the stopper 14 and the filter 18 as discussed above. The securing ring 16 defines an ingress/egress aperture 52 suitable to expose at least part of the resealable portion 30 of the stopper so as to enable a needle or other filling member to penetrate the stopper and thereby transfer a predetermined substance or compound to the body to be retained therein. As previously noted, the securing ring 16 has ring vents 46 sized, shaped, and/or configured to cooperate with the stopper vents 34 so as to provide for effective venting during the lyophilization process and/or to maintain effective equilibrium between the inside of the body and the ambient atmosphere.

As may be recognized by those of ordinary skill in the pertinent art based on the teachings herein, the securing ring 16 may be attached to the body 12 and/or stopper 14 in any of the numerous different ways, including, for example, by overmolding the securing ring onto the body and/or stopper, by mechanical snap-fit or other interlocking engagement between the securing ring and the body, by adhesively joining the securing ring to the body and/or stopper, or by ultrasonic welding. Although not required with certain embodiments, to further effectuate consistent alignment of the ring vents 46 with the stopper vents 34, the securing ring 16 may be keyed with respect to the body and/or stopper so as to ensure appropriate vent alignment and thereby ensure the proper venting effect. If desired, the securing ring 16 can be formed so that it completely overlies the stopper 14. In operation, the stopper 14 is penetrable through the aperture 52 of the securing ring 16 by a needle or like filling member for the introduction of a substance for lyophilization into the device 10. Upon withdrawal of the filling needle, thermal energy, such as radiation transmitted by a laser source at a predetermined wavelength and power, is applied to the penetrated region of the stopper to seal the hole created by the filling needle.

Figure 5:
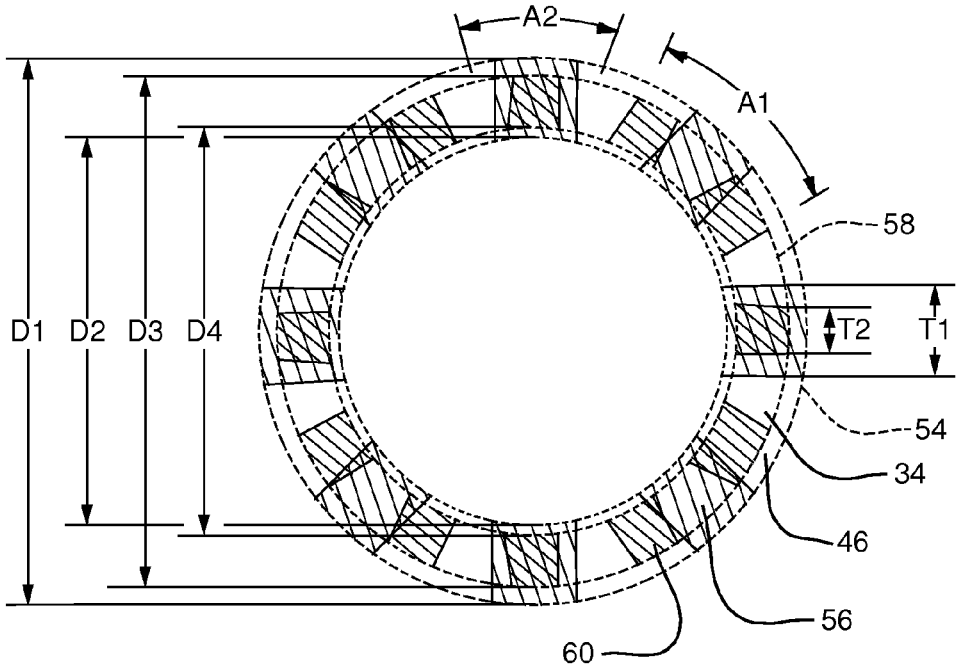
FIG. 5 is a schematic illustration of an exemplary venting pattern of the device of FIG. 1 illustrating the securing ring vent pattern overlying the stopper vent pattern.

Referring to FIG. 5, a vent pattern in accordance with an illustrative aspect is shown schematically with the pattern of the ring vents 46 overlying the pattern of the stopper vents 34. To effectuate a substantially consistent venting through the filled, sealed and sterilized device 10 during the lyophilization process, the vents of both the stopper 14 and the securing ring 16 are arranged in complementary predefined patterns. The securing ring 16 has a predefined number of ring vents 46 angularly spaced relative to each other in a predefined pattern. For example, as shown, the securing ring can have eight (8) ring vents 46 substantially equally spaced relative to each other in a first circular array 54 defining a predefined first outer diameter D1 (e.g., about 13 mm) and a predefined first inner diameter D2 (e.g., 9.5 mm). The ring vents 46 are oriented at a predefined first angle A1 (e.g., about 45 degrees) with respect to each other (i.e., the radial center lines of adjacent ring vents 46 are oriented at an acute angle Al relative to each other), and each ring vent 46 is separated from an adjacent ring vent by a respective ring rib 56 having a predefined angular width or thickness T1 (e.g., about 1.8 mm). The stopper 14 has a predefined number of stopper vents 34 angularly spaced relative to each other in a predefined array that is complementary to the ring vent 46 array of the securing ring 16. In the exemplary embodiment wherein the securing ring 16 has eight (8) ring vents 46 as described above, the stopper 14 is provided with twelve (12) stopper vents 34 disposed in a second circular array 58. The second circular array 58 has a predefined second outer diameter D3 that is in some such embodiments substantially equal to or less than the first outer diameter D1 of the ring vent 46 array, and a predefined second inner diameter D4 that is substantially equal to or greater than the first inner diameter D2 of the ring vent 46 array. The stopper vents 34 are oriented at a predefined second angle A2 (e.g., about 30 degrees) with respect to each other (i.e., the radial center lines of adjacent stopper vents 34 are oriented at an acute angle A2 relative to each other), and each stopper vent 34 is separated from an adjacent stopper vent by a respective stopper rib 60 having a predefined angular width or thickness T2 (e.g., about 1.3 mm). Each ring rib 56 and stopper rib 60 may define a uniform angular thickness or width T1 or T2, or may define a width that progressively increases such that the opposing sides of each rib extend radially in the direction from the inner diameter toward the outer diameter of the respective array (see FIGS. 2*b*, 2*c*, 4*b* and 4*c*). As may be recognized by those of ordinary skill in the pertinent art based on the teachings herein, the vents and vent patterns disclosed herein may take any of numerous different shapes and configurations, and the stopper and/or securing ring may define any of numerous different numbers of such vents of any of numerous different sizes. In addition, the particular dimensions and angles disclosed herein are only exemplary, and any of numerous other dimensions and/or angles may be employed.

The first vent array 54 cooperates with the second vent array 58 and filter 18 to provide means for sterile or aseptic venting of the device 10 through the filter 18 during the lyophilization process. When the stopper 14 and securing ring 16 are assembled to the body12, the first or ring vent array 54 is randomly positioned over the second or stopper vent array 58. As can be seen in FIG. 5, in the illustrated embodiment, because the first vent array 54 defines a larger venting cross-sectional area than the second vent array 58, there is sufficient exposure of the stopper vents 34 to the ambient atmosphere through the filter 18 and ring vents 46 to lyophilize the substance within the chamber. Because the venting area provided by the first vent array 54 is greater than that of the second vent array 58, the overall venting effect is governed by the venting parameters associated with the second vent array 58 and the filter 18. In operation, water vapor emanating from an active substance held in the body 12 during sublimation may traverse the stopper 14, via the stopper vents 34, pass through the filter 18, via the porous material properties thereof, and exit the device through the ring vents 46 into the ambient atmosphere. If desired, and in accordance with another aspect, the filter 18 may be configured in a manner known to those of ordinary skill in the pertinent art, so as to allow ambient air or other gases to enter the body 12 through a reverse process whereby unwanted moisture is prevented from entering the body while equilibrium is substantially maintained between the pressure inside and the pressure outside the body or chamber therein. The filter 18 thus maintains sterility as well as provides an MVT barrier preventing moisture and/or vapor, or an undesirable amount thereof, from entering the body chamber and compromising the lyophilized substance therein. The foregoing vent arrangement, as well as other comparable arrangements that may be readily apparent to those of pertinent skill in the art based on the teachings herein, may be advantageously utilized in the present invention so as to facilitate providing substantially the same venting effect irrespective of the particular orientation of the securing ring 16 relative to the stopper 14.

As previously noted, the device 10 may include a vent seal 20 (shown in FIG. 4*a*) that is seated between the securing ring 16 and cover 22, or is otherwise secured to the securing ring 16 if there is no cover, so that the seal 20 overlies the first and second vent arrays 56 and 58, respectively, and effects a fluid-tight seal between the vent arrays and the ambient atmosphere. The vent seal 20 allows the vents 34 and 46 to be sealed at any time during, but also after the lyophilization processes is completed. The vent seal 20, as shown, can have an opening 21 therein for allowing access to the resealable portion 30 of the stopper 14. The vent seal 20 can be made of any of a variety of materials for effecting a fluid-tight seal, including those materials used to form the body 12 and/or the securing ring 16.

As noted above, the device 10 can have a cover 22 as shown typically in FIG. 1. The cover 22, as shown, is a snap-off, tamper-resistant cover configured to engage the outer periphery of the securing ring 16 and overlie the ingress/egress aperture 52 thereof to thereby protect the exposed resealable portion 30 of the stopper 14. The cover 22 can be engaged with the securing ring 16 by means of a press-fit connection such that the base portion of the cover is press fit into an annular recess 23 of the securing ring 16 and is fixedly secured thereto. The cover and securing ring can include engageable locking members (not shown) that prevent removal of the cover once press fit into place. However, as may be recognized by those of ordinary skill in the pertinent art based on the teachings herein, any of numerous different connection mechanisms that are currently known, or that later become known equally may be employed, such as ultrasonic welding, an adhesive, or another type of mechanical connection. The cover 22 includes a frangible portion 64 that is movable between a closed position (shown in FIG. 1) connected to the cover and substantially sealing the needle penetrable and laser resealable portion from the ambient atmosphere, and an open position (not shown) removed from the cover and exposing the needle penetrable and laser resealable portion 30 of the stopper 14. The frangible portion 64 of the cover 22 defines on its underside an annular protuberance 66 that is pressed into engagement with the adjacent stopper material 30 to thereby effectuate a third fluid-tight seal 62 for sealing the exposed portion of the resealable stopper and thereby protect it from the ambient atmosphere and provide an effective MVT barrier. In the illustrated embodiment, the cover 22 cannot be removed from the device and/or body without breaking either the cover 22 or the frangible portion 64 thereof, thereby providing a tamper-resistant feature. Alternatively, the cover 22 can be connected to the securing ring 16 via ultrasonic welding, adhesion, or any other connection technique suitable to engage the cover 22 with securing ring 16 so that once removed, the cover 22 can not be re-engaged with the securing ring 16.

Thus, the device 10 can be constructed as discussed above (i.e., without any seal 20 or tamper-evident cover 22) before introducing any substance to be lyophilized into the body chamber. Then, one or more of such empty devices 10 are assembled as shown in FIG. 1, sterilized, and, if desired, may be transported in accordance with the teachings of the present inventor's commonly owned U.S. Pat. No. 5,186,772, entitled "Method Of Transferring Articles, Transfer Pocket And Enclosure", and/or U.S. patent application Ser. No. 10/241,249, entitled "Transfer Port And Method For Transferring Sterile Items", filed Sep. 10, 2002, each of which is hereby expressly incorporated by reference as part of the present disclosure.

The sealed, empty, sterilized device 10 may be filled via any of the filling machines disclosed in the co-pending patent applications and patents incorporated by reference below. For example, if desired, the sealed, empty devices 10 may be sterilized within a filling machine that utilizes gamma and/or e-beam radiation to sterilize the devices, and/or to sterilize selected surfaces of pre-sterilized devices prior to needle filling and laser resealing. The sealed, sterile devices 10 then may be needle filled in a filling station (the filling station may include a substantially laminar flow of sterile air or other gas to maintain aseptic conditions). As necessary or desirable, an e-beam or other radiation source may be used to sterilize the exposed resealable portions of the stoppers, other external surfaces of the device, and/or the filling needle(s), as appropriate to further ensure sterilization prior to engagement of the needle penetrable region of the stopper with the filling needle or other filling member. For example, the filling station may be located within an e-beam chamber the same as or similar to that disclosed in commonly assigned U.S. patent application Ser. No. 10/600,525, which is hereby expressly incorporated by reference as part of the present disclosure. A laser or other radiation source alternatively may be employed if desired to scan or otherwise subject the exposed surface(s) of the stopper and/or needle to radiation prior to or during filling to further ensure the sterility of such surfaces. The resulting needle hole in the filled device 10 is then laser resealed in the same manner, or in a manner similar to that described in the following commonly assigned co-pending patent applications and/or patents, each of which is hereby expressly incorporated by reference as part of the present disclosure: U.S. patent application Ser. No. 10/766,172 filed Jan. 28, 2004, entitled "Medicament Vial Having A Heat-Sealable Cap, And Apparatus and Method For Filling The Vial", which is a continuation-in-part of similarly titled U.S. patent application Ser. No. 10/694,364, filed Oct. 27, 2003, which is a continuation of similarly titled co-pending U.S. patent application Ser. No. 10/393,966, filed Mar. 21, 2003, which is a divisional of similarly titled U.S. patent application Ser. No. 09/781,846, filed Feb. 12, 2001, now U.S. Pat. No. 6,604,561, issued Aug. 12, 2003, which, in turn, claims the benefit of similarly titled U.S. Provisional Application Ser. No. 60/182,139, filed Feb. 11, 2000; similarly titled U.S. Provisional Patent Application No. 60/443,526, filed Jan. 28, 2003; similarly titled U.S. Provisional Patent Application No. 60/484,204, filed Jun. 30, 2003; U.S. patent application Ser. No. 10/655,455, filed Sep. 3, 2003, entitled "Sealed Containers And Methods Of Making And Filling Same"; U.S. Provisional Patent Application Ser. No. 60/518,685, filed Nov. 10, 2003, entitled "Needle Filling And Laser Sealing Station"; U.S. Provisional Patent Application No. 60/550,805, filed Mar. 5, 2004, entitled "Apparatus For Needle Filling And Laser Resealing"; and U.S. Provisional Patent Application Ser. No. 60/551,565, filed Mar. 8, 2004, entitled "Apparatus And Method For Molding And Assembling Containers With Stoppers And Filling Same".

The filled devices 10 each contain a predetermined amount of substance to be lyophilized, and both the substance and the interiors of the devices are aseptic or sterile. The filters 18 and the first and second vent arrays 56 and 58 allow venting of the interior chambers of the bodies 12 therethrough during lyophilization while nevertheless maintaining the sterile or aseptic condition of the interiors of the devices 10.

The filled device 10 containing a predetermined amount of substance to be lyophilized is then placed in a lyophilization station (not shown) of a general type known to those of ordinary skill in the pertinent art. If desired, the lyophilization station may be operatively associated with the filling machine so as to efficiently and effectively maintain the sterility of the device. For example, the lyophilization chamber or chambers may be located in line with the needle filling and laser resealing station or stations so that the devices can be needle filled and laser resealed with the substance to be lyophilized immediately prior to lyophilization. If desired, a common conveyor of a type known to those of ordinary skill in the pertinent art, such as an endless screw-type conveyor, a star wheel conveyor, a vibratory feed conveyor, or any of numerous other conveyors may be employed to transport the filled devices from the needle filling and laser resealing station(s) to the lyophilization station(s). Once placed in the lyophilization station, the substance retained in the device is subjected to a lyophilization process. Typically, the first step in the lyophilization process is to freeze the product or substance to solidify all of its water molecules. Once frozen, the device may be subjected to primary and secondary drying stages. During the primary drying stage, the substance is placed in a vacuum and subjected to sublimation (i.e., transformation of ice directly into water vapor without first passing through the liquid state). The water vapor given off by the substance during sublimation is vented through the device 10, via the vent arrays 56, 58 and filter 18, and condenses as ice on a collection trap (e.g., a condenser, not shown) within the lyophilization vacuum chamber. If desired, the devices 10 may be subjected to the freezing and drying stages in the same chamber or in different chambers.

In may cases in order for the substance to be considered stable, a lyophilized substance should contain about 3% or less of its original moisture content and be properly sealed. As soon as a lyophilized substance is exposed to moisture levels higher than about 3%, its stability may be compromised. In many cases, a properly lyophilized substance must be sealed within its device or container prior to exposure of the device or container to the ambient atmosphere. A lyophilized substance that has been dried to less than about 3% residual moisture or other residual moisture level may, when exposed to an environment having greater than its own moisture level, absorb as much moisture as it can resulting in substance degradation and all of the desirable characteristics of a lyophilized substance such as increased shelf life, enhanced chemical performance, and rapid reconstitution may be compromised.

Accordingly, the device 10 can effectuate a fluid impermeable seal and provides an appropriate MVT barrier between the interior of the body chamber and the exterior of the device. In one embodiment, the filter 18 provides a sufficient MVT barrier which maintains the interior chamber and lyophilized substance sterile. In another embodiment, the cover 22 is fixedly connected to the securing ring 16, or the cover 22 with seal 20 is connected to the securing ring 16, to seal the filter 18 with respect to the ambient atmosphere prior to exposing the device to the atmosphere outside of the lyophilization chamber(s) and/or other sterile or aseptic chamber of the lyophilization and/or filling and lyophilization machine.

One advantage of the device 10 is that it may eliminate the need to seal a device inside the lyophilizer prior to repressurization and thus, it may substantially minimize the risk of jeopardizing the stabilized chemistry of the lyophilized substance by exposure to unacceptably high and variable moisture levels as encountered during conventional sealing processes, as well as subsequent packaging, transporting, and storage, to thereby provide a quality product upon reconstitution.

Another advantage of the present invention is that the gaseous moisture which is removed from the substance during the lyophilization process is effectively vented through a sealed, sterile device. The present invention also advantageously eliminates the extra processing steps of seating a stopper partially in the body during lyophilization and subsequently closing or sealing the body via the stopper and a possible crimping element as encountered in the prior art. This advantageously simplifies the mechanical equipment used in the lyophilization process (e.g., no need for moving shelves), and reduces or eliminates the negative effects associated with the shelves interacting with containers and/or container stoppers as previously noted. Still further, the present invention can facilitate maintaining equilibrium in pressure between the inner device and the ambient atmosphere during the reconstitution process, and thereby positively influence (e.g., minimize) the undesirable head space often created during the reconstitution process. This can reduce the length of time needed before proceeding with administration of the reconstituted substance.

Another advantage the present invention is that the sterile filter 18 maintains the interior chamber of the body, and thus the substance contained therein, sterile, even when the cover 22 and/or sealing member 20 is removed. As a result, when the substance within the device is reconstituted, such as by inserting a needle through the needle penetrable portion 30 of the stopper 14 and injecting a diluent or other fluid into the chamber, the sterile filter 18 may allow sterile gas, such as air, to enter the interior chamber of the device to facilitate mixing the lyophilized substance and diluent or other fluid. Yet another advantage of the illustrated embodiment of the device 10 is that the smooth, radiused internal contour defined by the stopper surfaces 36 and 37 facilitates in allowing all of the lyophilized substance to become reconstituted without becoming deposited in corners or other regions of the stopper or body. Another advantage of the device 10 is that the device may hold multiple doses of the reconstituted substance, and the reconstituted substance remaining within the device after dispensing a dose (such as by inserting a needle through the penetrable region 30 of the stopper and withdrawing a dose through the needle) can be maintained sterile because the filter 18 sterilizes any air or other gas flowing into the interior chamber and prevents contaminants from passing therethrough and into the interior chamber, and the device otherwise is sealed with respect to the ambient atmosphere to prevent any contaminants from flowing into the interior chamber.

The body 12 of the device 10 can take any of numerous different configurations that are currently known, or that later become known, including but not limited to, vials, syringes, other containers or delivery devices, or any of the containers disclosed in commonly assigned U.S. patent application Ser. Nos. 10/766,172, 10/655,455, and 10/600,525, each of which is hereby expressly incorporated by reference as part of the present disclosure. Further, the body 12 can be made of any of numerous different types of glass or plastic, or any other material that is currently known, or later becomes known, for use in connection with making containers suitable for storing medicaments or other substances to be lyophilized. For example, in some embodiments, the bodies are made of glass. In other embodiments, the bodies are made of a thermoplastic material, such as the thermoplastic material sold under the trademark TOPAS by Ticona Corp. of Summit, N.J. In some embodiments, the TOPAS material is sold under any of the following product codes: 5013, 5513, 6013, 6015, and 8007, and is a cyclic olefin copolymer and/or cyclic polyolefin.

In the illustrated embodiment, the stopper 14 is formed of a thermoplastic material defining the needle penetration region 30 that is pierceable with a needle to form a needle aperture therethrough, and is heat resealable to seal the needle aperture by applying energy (e.g., laser radiation) at a predetermined wavelength or power thereto. The stopper 14 includes a thermoplastic body defining an upper portion and lower portion. The body defines (i) a predetermined wall thickness in an axial direction thereof, (ii) a predetermined color and opacity that substantially absorbs laser radiation at the predetermined wavelength and substantially prevents the passage of radiation through the predetermined wall thickness thereof, and (iii) a predetermined color and opacity that causes the laser radiation at the predetermined wavelength and power to seal the needle aperture formed in the needle penetration region thereof in a predetermined time period and substantially without burning the needle penetration region (i.e., without creating an irreversible change in molecular structure or chemical properties of the material). In some embodiments, the predetermined time period is approximately 2 seconds, or less than or equal to about 1.5 seconds, or even less than or equal to about 1 second. In some of these embodiments, the predetermined wavelength of the applied energy is about 980 nm, and the predetermined power of each energy source is less than about 30 Watts, or less than or equal to about 10 Watts, or even within the range of about 8 to about 10 Watts. Also in some of these embodiments, the predetermined color of the material is gray, and the predetermined opacity is defined by a dark gray colorant (or pigment) added to the stopper material in an amount within the range of about 0.3% to about 0.6% by weight.

In addition to the thermoplastic materials described above, the thermoplastic material may be a blend of a first material that is, e.g., a styrene block copolymer, such as the materials sold under either the trademarks KRATON or DYNAFLEX, such as DYNAFLEX G2706-10000-00, or GLS 230-174 (Shore A=30), and a second material that is, e.g., an olefin, such as the materials sold under either the trademarks ENGAGE or EXACT, such as EXACT 8203, or GLS 230-176 (Shore A=42). In some aspects, the first and second materials are blended within the range of about 50:50 by weight to about 90:10 by weight, and even about 90:5 by weight (i.e., first material:second material). The benefits of this blend over the first material by itself are improved water or vapor barrier properties, and thus improved product shelf life; improved heat sealability; a reduced coefficient of friction; improved moldability or mold flow rates; and a reduction in hystereses losses.

An important feature of the stopper 14 is that it be resealable to form a fluid-tight seal in the penetrated region thereof after inserting a needle, syringe or like injection member therethrough. In some embodiments, the resealable portion can be sealed by heating the area punctured by the needle as described further below. One advantage of the blended polymer described above is that it is known to minimize the degree to which a medicament or other substance to be lyophilized can be absorbed into the polymer in comparison to either KRATON® or DYNAFLEX® itself.

Alternatively, the thermoplastic material of the stoppers may take the form of a styrene block copolymer sold by GLS Corporation of McHenry, Ill. under the designation LC 254-071. This type of styrene block copolymer compound exhibits approximately the following physical properties: (i) Shore A Hardness: about 28-29; (ii) Specific Gravity: about 0.89 g/cm3; (iii) Color: approximately grey to dark grey; (iv) 300% Modulus, flow direction: about 181-211 psi; (v) Tensile Strength at Break, flow direction: about 429-498 psi; (vi) Elongation at Break, flow direction: about 675%-708%; and (vii) Tear Strength, flow direction: about 78-81 lbf/in.

In each of the foregoing embodiments, the predetermined color and opacity of the thermoplastic is defined by a grey colorant that is provided in an approximately 3% color concentrate (i.e., there is an approximately 33:1 ratio of the concentrate to the natural resin or TPE). The color concentrate contains about 88.83% carrier or base resin, the remainder is pigment, and the pigment is grey carbon black. Thus, the pigment is about 0.34% by weight of the resulting thermoplastic.

In addition, if desired, a lubricant of a type known to those of ordinary skill in the pertinent art may be added to or included within each of the above-mentioned thermoplastic compounds, in order to prevent or otherwise reduce the formation of particles during penetration and withdrawal of the needle penetration region of the thermoplastic portion by a needle or other filling member. In one embodiment, the lubricant is a mineral oil that is added to the styrene block copolymer or other thermoplastic compound in an amount sufficient to prevent, or substantially prevent, the formation of particles upon penetrating same with the needle or other filling member. In another embodiment, the lubricant is a silicone, such as the liquid silicone sold by Dow Corning Corporation under the designation "360 Medical Fluid, 350 CST", or a silicone oil, that is added to the styrene block copolymer or other thermoplastic compound in an amount sufficient to prevent, or substantially prevent, the formation of particles during penetration and withdrawal of the needle or other filling member. In one such embodiment, the silicone oil is included in an amount within the range of about 0.4% to about 1% by weight, or within the range of about 0.4 to about 0.6% by weight, or even within the range of about 0.51 or about 0.5% by weight.

In accordance with another embodiment, a needle penetrable and laser resealable stopper comprises: (i) a styrene block copolymer, such as any such styrene block copolymers described above, within the range of about 80% to about 97% by weight (e.g., about 95% as described above); (ii) an olefin, such as any of the ethylene alpha-olefins, polyolefins or olefins described above, within the range of about 3% to about 20% by weight (e.g., about 5% as described above); (iii) a pigment or colorant added in an amount sufficient to absorb the laser energy, convert the radiation to heat, and melt the stopper material, e.g., to a depth equal to at least about ⅓ to about ½ of the depth of the needle hole, within a time period of less than about 2 seconds, or less than about 1.5 seconds, or even less than about 1 second; and (iv) a lubricant, such as a mineral oil, liquid silicone, or silicone oil as described above, added in an amount sufficient to substantially reduce friction forces at the needle/stopper interface during needle penetration of the stopper to, in turn, substantially prevent particle formation.

In addition, controlling one or more of the above-mentioned parameters to reduce and/or eliminate the formation of particles (i.e., including the silicone oil or other lubricant in the thermoplastic compound, and controlling the configuration of the needle, the degree of friction at the needle/stopper interface, and/or the needle stroke through the stopper), the differential elongation of the thermoplastic components of the stopper is selected to reduce and/or eliminate the formation of particles.

Thus, the needle penetrable and laser resealable stopper may comprise: (i) a first thermoplastic material within the range of about 80% to about 97% be weight and defining a first elongation; (ii) a second thermoplastic material within the range of about 3% to about 20% by weight and defining a second elongation less than the elongation of the first material; (iii) a pigment or colorant added in an amount sufficient to absorb the laser energy, convert the radiation to heat, and melt the stopper material, e.g., to a depth equal to at least about ⅓ to about ½ of the depth of the needle hole, within a time period of less than about 2 seconds, or less than about 1.5 seconds, or even less than about 1 second; and (iv) a lubricant, such as a mineral oil, liquid silicone, or silicone oil as described above, added in an amount sufficient to substantially reduce friction forces at the needle/stopper interface during needle penetration of the stopper to, in turn, substantially prevent particle formation.

In one embodiment of the device, the first material defines a lower melting point (or Vicat softening temperature) than does the second material. In one such embodiment, the first material is a styrene block copolymer, such as any of the styrene block copolymers described above, and the second material is an olefin, such as any of the ethylene alpha-olefins, polyolefins or olefins described above. Also in one such embodiment, the first material defines an elongation of at least about 75% at 10 lbs force (i.e., the length increases by about 75% when subjected to a 10 lb force), or at least about 85%, or even at least about 90%; and the second material defines an elongation of at least about 5% at 10 lbs force, or at least about 10%, or at least about 15%, or within the range of about 15% and about 25%. With respect to the above-mentioned materials, the elongation of each at 10 lbs force is approximately as follows: (1) GLS 230-176 (Shore A-42)—14.35% to 16.42%; (2) Exact 8203 (Shore A=40)—17.87% to 19.43%; (3) GLS 230-174 (Shore A=30)—81.67% to 83% (about 9 to 9.5 lbs force); and (4) Dynaflex G2706 (Shore A=30)—76.85% to 104.95%. In addition, the Vicat softening point or temperature for Engage 8400 is about 41° C., and for Exact 8203 is about 51° C.

The needle employed to penetrate the stoppers can define a conically-pointed, non-coring tip (i.e., a "pencil point" tip), wherein the included angle of the tip in cross-section is within the range of about 15° to about 25°, or about 18° to about 22°, or even about 20°. The smooth, sharply-pointed, gradually increasing angle of the needle tip allows for a relatively smooth, and gradual expansion of the needle hole upon penetrating the stopper. Further, the memory of such thermoplastic blends causes the needle hole to substantially close on itself upon withdrawing the needle therefrom, thus reducing the requisite area of impingement by the laser beam for resealing, and reducing cycle time. In addition, this further reduces the possibility of contaminating the interior of the body between needle filling and laser resealing. If desired, the stopper surface may be Teflon™ coated or otherwise coated with a low-friction material to further reduce friction, and thus the formation of particles, at the needle/stopper interface. The needle tip further defines axially oblong flow apertures on opposite sides of the needle relative to each other. In one embodiment, the needle is about 15 gage (i.e., about 0.072 inch diameter).

If desired, the needle/stopper interface may be treated to reduce the degree of friction therebetween to further reduce the formation of particles during the needle stroke. In one embodiment, the needle is tungsten carbide carbon coated. In another embodiment, the needle is electro-polished stainless steel. In another embodiment, the needle is Teflon™ coated (although this embodiment can give rise to greater friction forces at the needle/stopper interface than with the tungsten carbide carbon coated embodiment). In yet another embodiment, the needle is titanium coated to reduce friction at the needle/stopper interface. Further, in some embodiments, the depth of stroke of the needle is set to further reduce the formation of particles. In one such embodiment, at the bottom of the needle stroke, the needle flow apertures are spaced below the bottom wall of the stopper and adjacent or contiguous thereto (i.e., the upstream end of each hole is adjacent to the inside surface of the bottom wall of the stopper). In one such embodiment, the needle tip penetrates beyond the inside surface of the bottom wall of the stopper to a depth within the range of about 1 to about 5 cm, or within the range of about 1 to about 3 cm, or even about 1.5 centimeters.

As may be recognized by those skilled in the pertinent art based on the teachings herein, the specific formulations of the polymeric compounds used to form the stoppers and the bodies or other components of the device can be changed as desired to achieve the desired physical characteristics, including sorption (both absorption and adsorption), and moisture-vapor transmission ("MVT"). For example, the wall thicknesses of the stoppers can be increased or otherwise adjusted in order to provide an improved or otherwise adjusted MVT barrier. Alternatively, or in conjunction with such measures, the blend of components forming the thermoplastic compounds may be changed as desired to meet desired sorption levels with the particular product(s) to be contained within the device, and/or to achieve desired MVT characteristics. Still further, in some embodiments of the device employing multiple layers of fusible and infusible materials, the relative thickness of the different materials can be adjusted to, in turn, adjust the MVT characteristics of the stopper. In addition, and/or in conjunction with any of the foregoing measures, a cover may cooperate with the securing ring 16 to seal the stopper with respect to the ambient atmosphere and thereby improve the MVT characteristics of the device. As also may be recognized by those of ordinary skill in the pertinent art based on the teachings herein, the above-mentioned numbers and materials are only exemplary, and may be changed as desired or otherwise required in a particular system.

One advantage of the present invention is that the resealable portion of the stopper may be resealed following the deposit of a substance into the device. Accordingly, an advantage of the present invention is that all components of the device may be molded from thermoplastics or other plastic materials, thus facilitating the manufacture of significantly safer, sterile, pyrogen free devices or containers in comparison to the prior art. For example, the stoppers and bodies can be molded in machines located side-by-side (or otherwise in close proximity to each other), wherein each molding machine is located under a laminar flow hood (or both machines are located under the same laminar flow hood), Then, the stoppers are assembled and sealed to the respective bodies (or vice versa) promptly after molding (and while still hot or at a bactericidal temperature) under the laminar flow hood by, for example, a suitable assembly fixture wherein a plurality of stoppers are brought into engagement with a plurality of container bodies (or vice versa), or by a pick-and-place robot. As a result, the interiors of the sealed devices are sterile and pyrogen free promptly upon being molded substantially without risk of contamination.

Figure 6:
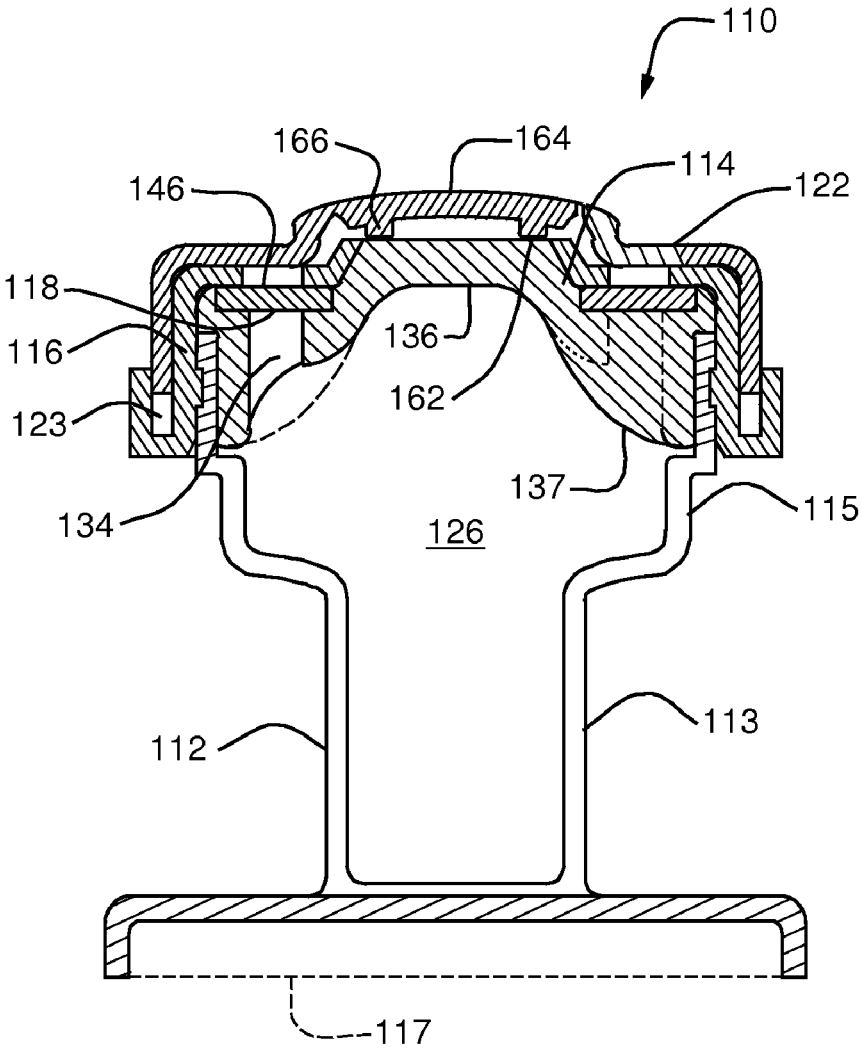
FIG. 6 is a cross-sectional view of another embodiment of a lyophilization device including a body defining a relatively narrow base portion for receiving therein the lyophilized substance, and an expanded upper portion for receiving the diluent or other fluid for reconstituting the lyophilized substance.

In FIG. 6 another lyophilization device is indicated generally by the reference numeral 110. The device 110 is substantially similar to the device 10 described above with reference to FIGS. 1 through 5, and therefore like reference numerals preceded by the numeral "1" are used to indicate like elements. The primary difference of the device 10 in comparison to the device 110 described above, is that the body 112 defines a relatively narrow base portion 113 for receiving therein the lyophilized substance, and an expanded upper portion 115 for receiving the diluent or other fluid for reconstituting the lyophilized substance. In the illustrated embodiment, the body 12 is cylindrical, and therefore the base portion 113 defines a lesser diameter than the upper portion 115. However, as may be recognized by those of ordinary skill in the pertinent art based on the teachings herein, the body may define any of numerous other cross-sectional shapes, such as square or rectangular. One advantage of this embodiment, is that the device may receive and form a "cake" of lyophilized substance that is the same as or similar to that formed in prior art lyophilization vials, while permitting for an expanded upper region for receiving the diluent and otherwise accommodating the filter and venting arrays of the device 10. If desired, the base portion of the body 12 may define a smooth bottom surface as indicated by the broken line at 117 to prevent the formation of any air pockets underneath the device when located in a lyophilization chamber.

The present invention having been thus described with reference to various exemplary embodiments thereof, it will be obvious that various changes and modifications may be made therein without departing from the spirit of the present invention as defined herein. In addition, it is contemplated that the present invention may be utilized in a variety of different applications and in a variety of different ways. For example, the devices may take any of numerous different shapes, configurations or types for receiving and/or dispensing lyophilized substances that are currently known, or that later become known, including without limitation vials, syringes, and other delivery devices or containers. In addition, the stopper or other needle penetrable and laser resealable portion may be made of any of numerous different materials or combinations of materials, may take any of numerous different shapes or configurations, and may form any of numerous different parts of features of the respective devices, that are currently known, or that later become known. Still further, the filter or filters employed in the devices may take any of numerous different shapes or configurations, and/or be formed of any of numerous different materials that are currently known or that later become known. In addition, the lyophilization processes and/or equipment employed to lyophilize the substances in the devices of the present invention may take the form of any of numerous different lyophilization processes or equipment that are currently known, or that later become known. The substances to be lyophilized likewise may take the form of any of numerous different substances that are currently lyophilized or that later become lyophilized, including without limitation, any of numerous different pharmaceutical products, vaccines, biological products, food products, beverage products, nutritional products, and cosmetic products. Accordingly, this detailed description of embodiments of the present invention is to be taken in an illustrative as opposed to a limiting sense.

What is claimed is:

1. A method of filling a device with a substance to be lyophilized, lyophilizing the substance within the device, and storing the lyophilized substance within the device, the method comprising the following steps:

filling a device including a body defining a chamber enclosed by a liquid-impermeable closure in sealing engagement therewith and a penetrable and resealable portion in fluid communication with the chamber, the filling step comprising:

penetrating the penetrable and resealable portion with a tip of an injection or filling member such that a flow aperture of the injection or filling member is in fluid communication with the chamber of the device;

introducing the substance to be lyophilized through the injection or filling member and into the chamber of the device; and withdrawing the injection or filling member from the penetrable and resealable portion;

lyophilizing the substance within the chamber with the closure in engagement with the body, causing fluid to flow out of the chamber during lyophilization, and preventing at least one of contaminants and moisture from flowing into the chamber during lyophilization; and hermetically sealing an aperture formed by the injection or filling member in the penetrated region of the penetrable and resealable portion.

2. A method as defined in claim 1, wherein the device includes a filter in fluid communication between the interior and exterior of the chamber; and the lyophilizing step includes lyophilizing the substance within the chamber, causing fluid to flow through the filter and out of the chamber during lyophilization, and preventing the at least of contaminants and moisture from flowing through the filter and into the chamber during lyophilization.

3. A method as defined in claim 1, wherein the step of hermetically sealing the aperture occurs prior to the step of lyophilizing.

4. A method as defined in claim 1, wherein the lyophilization step includes freezing the substance within the chamber; subjecting the device to vacuum and removing ice from the chamber by sublimation; and then increasing the temperature within the chamber and desorbing residual moisture from the substance within the chamber.

5. A method as defined in claim 2, further comprising the step of sealing the filter and chamber with respect to the ambient atmosphere after the step of lyophilizing the substance within the chamber.

6. A method as defined in claim 1, further comprising the step of sterilizing the chamber.

7. A method as defined in claim 6, wherein the sterilizing step is performed prior to introducing the substance to be lyophilized through the injection or filling member and into the chamber.

8. A method as defined in claim 6, wherein the sterilizing step is selected from the group including (i) applying gamma radiation, (ii) applying e-beam radiation, and (iii) applying laser radiation, to the chamber.

9. A method as defined in claim 1, further comprising the step of configuring at least one of the penetrable and resealable portion and the injection or filling member to substantially prevent the formation of particles released into the chamber during injection or filling member penetration and withdrawal.

10. A method as defined in claim 1, wherein during lyophilization, fluid flows out of the chamber through the closure.

11. A method as defined in claim 1, wherein the injection or filling member is defined by a needle.

12. A method comprising the following steps:

filling a sealed empty sterile device including a body defining a chamber, and a penetrable and resealable portion forming a liquid-tight seal between the chamber and ambient atmosphere, the filling step comprising penetrating the penetrable and resealable portion with an injection or filling member and sterile filling a liquid substance to be lyophilized into the sealed, empty, sterile chamber through the penetrable and resealable portion;

providing at least one aperture through the penetrable and resealable portion to permit fluid to flow out of the chamber;

lyophilizing the substance within the chamber; and closing the at least one aperture and hermetically sealing the lyophilized substance within the chamber.

13. A method as defined in claim 12, wherein the closing step occurs after the lyophilizing step.

14. A method as defined in claim 12, further comprising the step of sterilizing the sealed empty device.

15. A method as defined in claim 14, wherein the sterilizing step includes at least one of i) irradiating the sealed empty device and ii) subjecting the device to at least one of gamma, e-beam and laser radiation.

16. A method as defined in claim 12, wherein the penetrable and resealable portion is defined by a stopper.

17. A method as defined in claim 12, wherein the injection or filling member is defined by a needle.

18. A method as defined in claim 12, wherein the penetrable and resealable portion is resealable by applying energy or radiation from a source thereof to a penetrated region of the penetrable and resealable portion.

19. A method as defined in claim 18, wherein the penetrable and resealable portion is resealable by at least one of (i) applying laser radiation and (ii) applying thermal energy.

20. A method as defined in claim 12, wherein the penetrable and resealable portion includes an underlying portion formed of a material compatible with the substance and defining a substance-exposed surface exposed to the substance within the device, and a resealing portion overlying the underlying portion.

21. A method as defined in claim 20, wherein the underlying portion is substantially infusible in response to an application of the radiation or energy to the penetrable and resealable portion, and the resealing portion is fusible in response to the application of radiation or energy.

22. A method as defined in claim 21, further comprising applying radiation or energy to the resealing portion.

23. A method as defined in claim 12 including overlaying a covering portion over the penetrable and resealable portion, thereby at least one of forming a fluid-tight seal between the penetrable and resealable portion and the ambient atmosphere, and forming a barrier to the transmission of moisture and vapor therethrough.

24. A method as defined in claim 12, further comprising the step of preventing at least one of contaminants and moisture from flowing into the chamber during lyophilization.

25. A method as defined in claim 1, wherein the hermetically sealing step comprises applying energy or radiation from a source thereof to a penetrated region of the penetrable and resealable portion.

26. A method as defined in claim 1 including overlaying a covering portion over the penetrable and resealable portion, thereby at least one of forming a fluid-tight seal between the penetrable and resealable portion and the ambient atmosphere, and forming a barrier to the transmission of moisture and vapor therethrough.

27. A method as defined in claim 1, wherein the penetrable and resealable portion includes an underlying portion formed of a material compatible with the substance and defining a substance-exposed surface exposed to the substance within the device, and a resealing portion overlying the underlying portion.

28. A method as defined in claim 27, wherein the underlying portion is substantially infusible in response to an application of the radiation or energy to the penetrable and resealable portion, and the resealing portion is fusible in response to the application of radiation or energy.

29. A method as defined in claim 28, wherein the hermetically sealing step includes applying radiation or energy to the resealing portion.

* * * * *